United States Patent [19]

Blaese

[11] Patent Number: 5,061,940

[45] Date of Patent: Oct. 29, 1991

[54] ANTENNA WITH QUICK DISCONNECT WHIP

[76] Inventor: Herbert R. Blaese, 3314 Olcott Ave., Chicago, Ill. 60634

[21] Appl. No.: 635,265

[22] Filed: Dec. 28, 1990

[51] Int. Cl.[5] ..... H01Q 1/32; H01Q 1/50

[52] U.S. Cl. ..... 343/715; 343/906; 439/916

[58] Field of Search ..... 343/715, 702, 711, 900, 343/906, 901, 888; 439/34, 35, 540, 543, 550, 551, 916

[56] References Cited

U.S. PATENT DOCUMENTS

| | | | |
|---|---|---|---|
| 3,003,149 | 10/1961 | Grashow | 343/715 |
| 4,106,024 | 8/1978 | Nijman | 343/906 |
| 4,242,684 | 12/1980 | Wolverton | 343/715 |
| 4,266,227 | 5/1981 | Blaese | 343/715 |
| 4,760,401 | 7/1988 | Imazeki | 343/702 |

*Primary Examiner*—Michael C. Wimer

*Assistant Examiner*—Hoanganh Le

*Attorney, Agent, or Firm*—Gerstman & Ellis, Ltd.

[57] ABSTRACT

An antenna is provided having a base for connection to a vehicle, a radiator whip, and an electrical connector for connecting the radiator whip to the base. The electrical connector comprises a first member defining an opening and a second member defining another opening. The openings defined by the first and second members are in alignment when the electrical connector is in its first position. When the electrical connector is in a second position, the openings are in misalignment. The openings are of a size that is adapted to receive the radiator whip. Manually operable means are provided for rotating the electrical connector about the radiator whip from the first position in which the radiator whip may be removed from the electrical connector to a second position in which the radiator whip is locked with respect to the electrical connector.

12 Claims, 2 Drawing Sheets

ANTENNA WITH QUICK DISCONNECT WHIP

FIELD OF THE INVENTION

The present invention concerns an antenna having a novel quick disconnect mechanism.

BACKGROUND OF THE INVENTION

It is often necessary to remove an antenna from its mounting on a vehicle when the vehicle is in an automatic car wash. If the antenna is not removed, the radiator whip or the base structure of the antenna may be damaged. In some prior art antennas, the entire base structure to which the radiator is attached is removed with the radiator. In other prior art antennas, the radiator carries a small threaded base which is screwed out of engagement with the main base that is affixed to the vehicle. In other prior art antennas, a tool must be utilized to remove the radiator whip from the antenna base. In another prior art antenna, a spring operated bayonet mount is used to provide a quick disconnect.

Many of these prior art antenna mechanisms have been found to be unsatisfactory. In certain structures the threads have become damaged and it is difficult to screw the radiator whip back on to the base. In other structures, the quick disconnect mechanism, such as the spring operated bayonet mechanism, has added to the length of the antenna in a deleterious manner. Antennas which require tools for removing the radiator are disadvantageous because often the tool is not available.

It is, therefore, an object of the present invention to provide a disconnect mechanism for a radiator whip that is simple in construction and easy to operate.

Another object of the present invention is to provide a disconnect mechanism for radiator whip which does not require external tools.

A further object of the present invention is to provide a disconnect mechanism for an antenna radiator whip which has relatively few parts and is economical.

A still further object of the present invention is to provide a disconnect structure for a radiator whip which does not require an excessive length.

Another object of the present invention is to provide an antenna formed of components that are simple to manufacture and economical.

Other objects and advantages of the present invention will become apparent as the description proceeds.

BRIEF DESCRIPTION OF THE INVENTION

In accordance with the present invention, a antenna is provided which includes a base for connection to a vehicle, and a radiator whip. An electrical connector is provided for connecting the radiator whip to the base. The electrical connector defines an opening for receiving the radiator whip. Manually operable means are provided for rotating the electrical connector about the radiator whip from a first, unlocked position in which the radiator whip may be removed from the electrical connector to a second position in which the radiator whip is locked with respect to the electrical connector.

In the illustrative embodiment, the electrical connector comprises a first threaded member defining a portion of the opening and a second cooperatingly threaded member defining another portion of the opening. The opening portions defined by the first and second member are in alignment when the electrical connector is in its first position and the openings are in misalignment when the electrical connector is in its second position.

In the illustrative embodiment, the first and second threaded members have left-handed threads. The first member includes a threaded stud and the second member defines a threaded recess for engaging the stud. The opening extends entirely through the first and second member. The second member has an externally knurled surface for manual gripping. The first member has a seat surrounding the stud and the second member abuts the seat when the electrical connector is in its first position.

A more detailed explanation of the invention is provided in the following description and claims, and as illustrated in the accompanying drawing.

DETAILED DESCRIPTION OF THE ILLUSTRATIVE EMBODIMENTS

Figure 1:
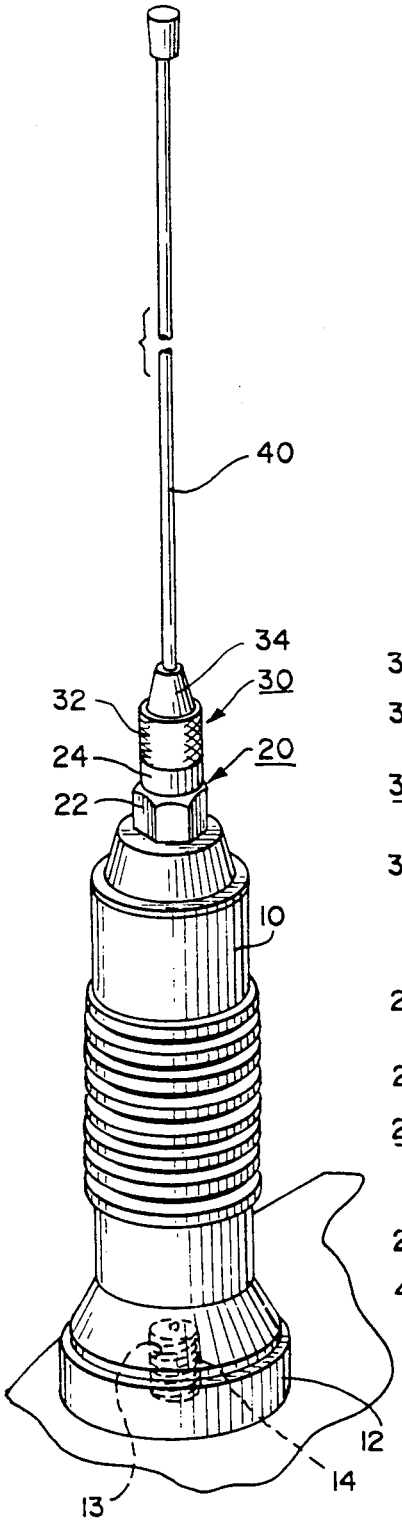
FIG. 1 is a perspective view of an antenna constructed in accordance with the principles of the present invention.
Figure 2:
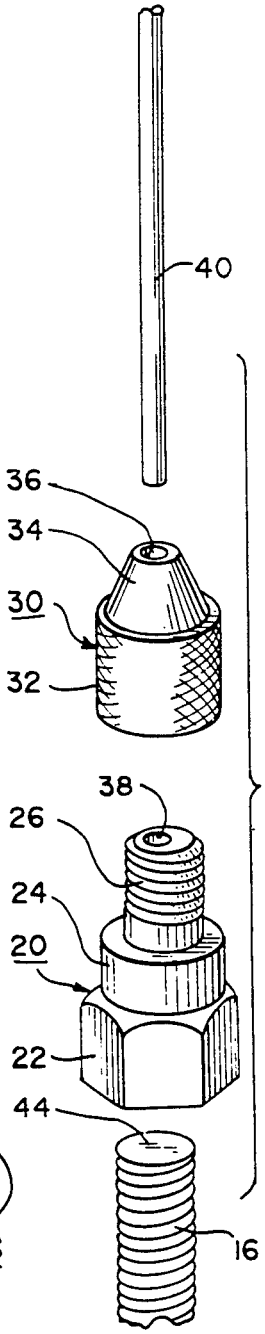
FIG. 2 is a partially broken exploded view of the components in the top portion of FIG. 1.

The antenna of the present invention includes a base 10 mounting on a vehicle. At the bottom 12 of base 10 there is an electrically conductive threaded receptacle 13 which engages with a threaded electrical connector 14 that extends through a surface of the vehicle to which base 10 is connected. The electrical connector 14 is coupled to a coaxial cable (not shown) that connects to the transmitter/receiver of the vehicle's citizen band radio, cellular telephone, or other device which is within the vehicle for transmitting and receiving.

Receptacle 13 is coupled through base 10 to a threaded stud 16 (FIGS. 2–5) which threadedly cooperates L with female threads 18 (FIGS. 3–5) of a first threaded member 20. First threaded member 20 includes a hexagonal shaped base portion 22, a cylindrically shaped midsection 24, and a male externally threaded stud 26.

The external threads of stud 26 cooperatively engage the internal threads 28 defined by a second threaded member 30. Second threaded member 30 has a main cylindrical surface 32 which is knurled for ease in manual gripping, and a truncated conical top portion 34.

Top portion 34 defines an opening 36 which extends through second threaded member 30 and communicates with opening 38 which extends through first threaded member 20. Radiator whip 40 is cylindrical and is received by openings 36 and 38, with the proximal end 42 of radiator 40 abutting the top 44 of stud 16.

Figure 3:
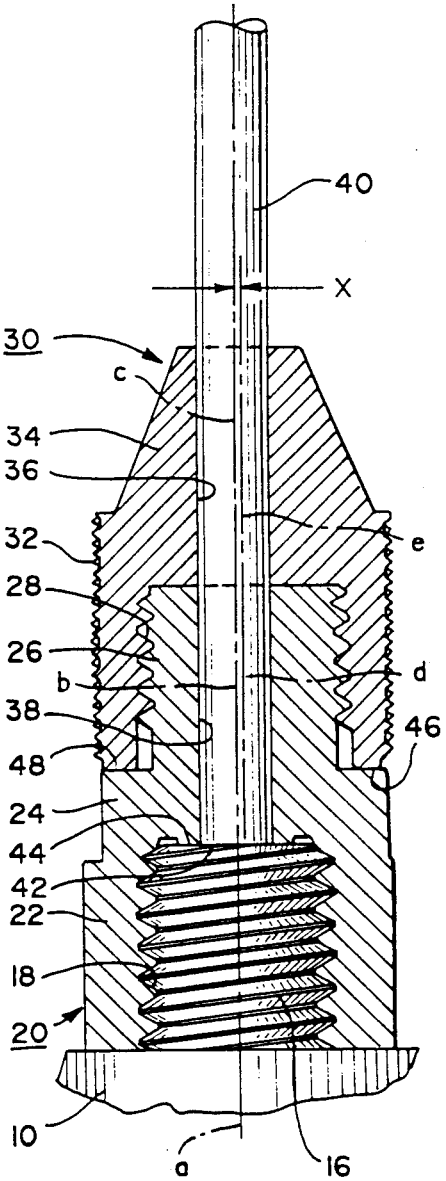
FIG. 3 is an enlarged cross-sectional view of the components of FIG. 2 when they are connected together and when the connector is in its first position.

The external threads of stud 26 and the internal threads of second threaded member 30 are preferably left-handed threads so that when second threaded member 30 is turned in the counter-clockwise direction (looking down from the top of the figures), second threaded member 30 will move downward with respect to stud 26 until bottom end 46 of second threaded member 30 abuts seat 48, which seat 48 surrounds stud 26. As illustrated in FIG. 3, when second threaded member 30 is in a first position in which its bottom end 46 is abutting seat 48, axis e of base 10, axis b of opening 38, and axis c of opening 36 are all coaxial. In this manner, radiator whip 40 can easily be inserted into openings 36 and 38 and the central axis of radiator whip 40 will be in coaxial alignment with axes a, b, c.

Figure 4:
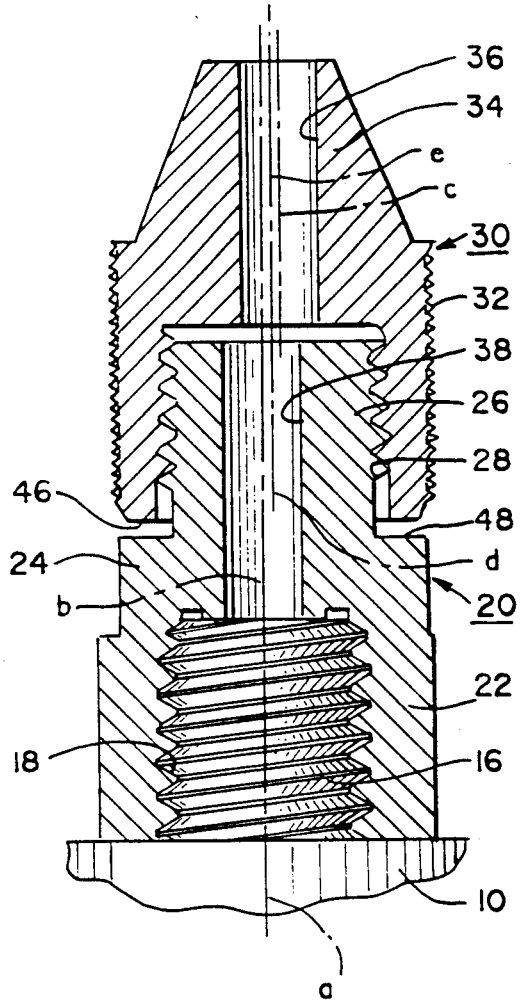
FIG. 4 is a cross-sectional view, similar to FIG. 3, but without showing the radiator whip and when the components are in their second position.

However, the first threaded member 20 and first threaded member 30 are offset so that their central axes are not coaxial with the central axes of their respective openings. Referring to FIG. 3, d represents the central axis of the first threaded member 20 and e represents the central axis of second threaded member 30. Thus the central axes of the threaded members are offset from the central axes of their respective openings by an amount x. In this manner, when first threaded member 20 is fastened tightly to stud 16 and second threaded member 30 is turned clockwise, the second threaded member 30 will tend to move to a second position such as illustrated in FIG. 4 in which its axis a is offset from axis d. This is shown in exaggerated form in FIG. 4. It can be seen that if the radiator whip is in place as illustrated in FIG. 3, and second threaded member 30 is turned clockwise, the second threaded member 30 will lock tightly onto radiator whip 40 to hold the radiator whip in place. On the other hand, when the radiator whip 40 is to be removed, second threaded member 30 can be turned counterclockwise so that openings 36 and 38 are aligned as illustrated in FIG. 3.

It is desirable for left-handed threads to be provided so that the counter-clockwise rotation will be used for removal of the radiator whip and clockwise rotation will be used for locking of the radiator whip. This will feel more conventional to the operator.

Figure 5:
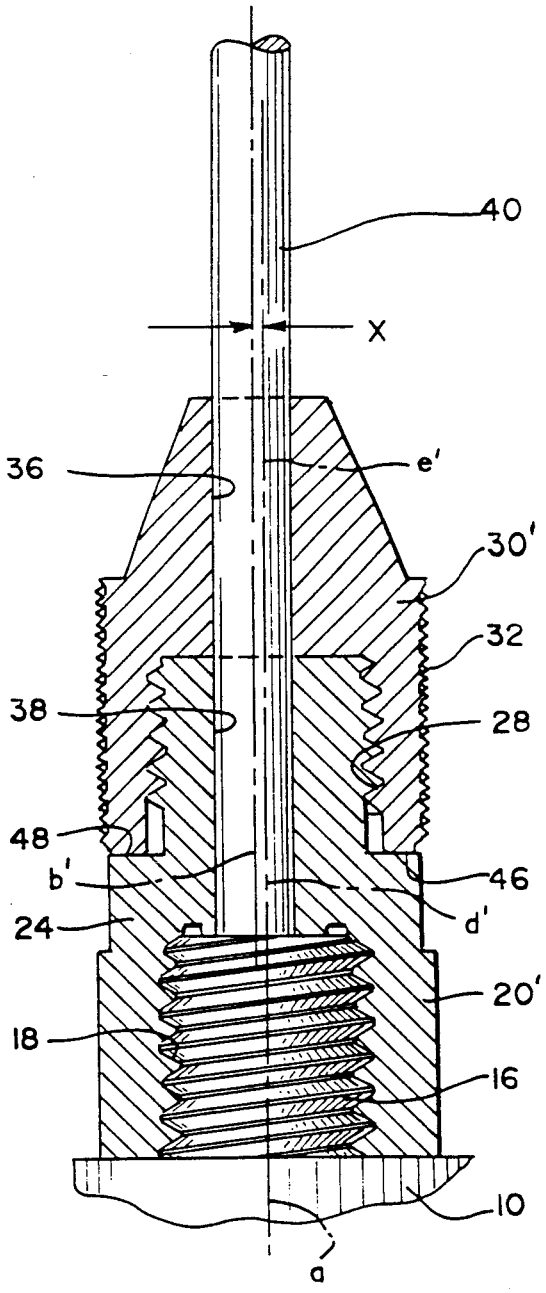
FIG. 5 is a cross-sectional view, similar to FIG. 3, but showing another form of the invention.

In FIG. 5 an alternative embodiment is illustrated in which the central axes d' and e' of first threaded member 20' and second threaded member 30', respectively, are aligned in coaxial arrangement with axis of the base. In the FIG. 5 embodiment, the central axis e' of opening 38 and c' of opening 36 are offset from central axes d', e' but are in alignment with each other when second threaded member 30' is in its first position, with bottom end 46 abutting seat 48. To achieve the embodiment of FIG. 5, all of the elements including the base 10, first threaded member 20' and second thread member 30' are aligned with each other and then the opening which forms openings 36 and 38 is drilled offset from the central axes a, d' and e', with an offset amount x as illustrated in FIG. 5.

In the FIG. 5 position, radiator whip 40 can be removed because openings 36 and 38 are in alignment. However, if second threaded member 30' is turned, opening 36 will tend to go out of alignment with opening 38 and will lock onto radiator whip 40, thereby locking radiator 40 in place with the electrical connector 20'; 30' being in a second position.

It can be seen that an electrical connector has been provided which is simple in construction, easy to manufacture, and enables quick removal of the radiator whip from the base, without requiring an excessively long connector mount. Although illustrative embodiments of the invention have been shown and described, it is to be understood that various modifications and substitutions may be made by those skilled in the art without departing from the novel spirit and scope of the present invention.

I claim:

1. An antenna which comprises:

a base for connection to a vehicle;

a radiator whip;

an electrical connector, for connecting said radiator whip to said base;

said electrical connector defining an opening for receiving said radiator whip;

manually operable means for rotating said electrical connector about said radiator whip from a first, unlocked position in which said radiator whip is removable from said electrical connector to a second position in which said radiator whip is located with respect to said electrical connector;

said electrical connector comprising a first threaded member defining a portion of said opening and a second cooperatingly threaded member defining another portion of said opening, with said opening portions defined by said first and second members being in alignment when said electrical connector is in its first position and said opening portions being in misalignment when said electrical connector is in said second position.

2. An antenna as defined by claim 1, in which said first and second threaded members have left-hand threads.

3. An antenna as defined by claim 2, in which said second member has an externally knurled surface for manual gripping.

4. An antenna as defined by claim 1, in which second member defines a threaded recess for engaging said stud, said opening extending entirely through said first and second member.

5. An antenna as defined by claim 4, in which said stud and said second member have coaxial central axes and said opening is offset from said coaxial central axes.

6. An antenna as defined by claim 4, in which said first member has a seat surrounding said stud and said second member abuts said seat when said electrical connector is in its first position.

7. An antenna as defined by claim 6, in which said first and second threaded members have left hand threads.

8. An antenna which comprises:

a base for connection to a vehicle;

a radiator whip; an electrical connector for connecting said radiator whip to said base;

said electrical connector comprising a first member defining an opening and a second member defining another opening, with the openings defined by said first and second members being in alignment when said electrical connector is in a first position and with said openings being in misalignment when said electrical connector is in a second position;

said openings being adapted to receive said radiator whip;

manually operable means for rotating said electrical connector about said radiator whip from said firs position in which said radiator whip is removable from said electrical connector to said second position in which said radiator whip is located with respect to said electrical connector.

9. An antenna as defined by claim 8, in which said first member includes a threaded stud and said second member defines a threaded recess for engaging said stud, said openings extending entirely through said first and second members.

10. An antenna as defined by claim 9, in which said stud and said second member have coaxial central axes and said opening of said second member is offset from said coaxial central axes.

11. An antenna as defined by claim 9, in which said first member has a seat surrounding said stud and said second member abut said seat when said electrical connector is in its first position.

12. An antenna as defined by claim 11, in which said first and second members have left hand threads.

* * * * *